US006435374B1

(12) United States Patent
Tabaroni

(10) Patent No.: US 6,435,374 B1
(45) Date of Patent: Aug. 20, 2002

(54) PEEL-OPENABLE CONTAINER

(75) Inventor: Roberto Tabaroni, Bazzano (IT)

(73) Assignee: Unfill International A/G, Glattbrugg (CH)

( * ) Notice: Subject to any disclaimer, the term of this patent is extended or adjusted under 35 U.S.C. 154(b) by 0 days.

(21) Appl. No.: 09/646,230

(22) PCT Filed: Mar. 25, 1999

(86) PCT No.: PCT/EP99/02035

§ 371 (c)(1),
(2), (4) Date: Jan. 19, 2001

(87) PCT Pub. No.: WO99/48768

PCT Pub. Date: Sep. 30, 1999

(30) Foreign Application Priority Data

Mar. 25, 1998 (IT) ..... MO98A0066

(51) Int. Cl.[7] ..... B65D 35/08
(52) U.S. Cl. ..... 222/107; 222/92
(58) Field of Search ..... 222/92; 1/107; D9/302, 305, 306

(56) References Cited

U.S. PATENT DOCUMENTS 3,051,368 A * 8/1962 Schneider et al. ..... 222/107
3,342,326 A * 9/1967 Zackheim ..... 222/92
3,740,237 A * 6/1973 Grindrod et al. ..... 222/92
3,791,570 A * 2/1974 Hopkins ..... 222/107
3,913,789 A * 10/1975 Miller ..... 222/107
3,917,116 A * 11/1975 Mason ..... 222/92
5,529,224 A * 6/1996 Chan et al. ..... 222/107
6,209,754 B1 * 4/2001 Suzumi ..... 222/92

* cited by examiner

*Primary Examiner*—William C. Doerrler
*Assistant Examiner*—Thach H Bui
(74) *Attorney, Agent, or Firm*—Reising, Ethington, Barnes, Kisselle, Learman & McCulloch, P.C.

(57) ABSTRACT

A container (1) for a flowable product comprises a first wall (2) and a second wall (3) joined along their respective edges by means of a peelable weld (4) and defining a cavity (7) for the product and an opening zone (5) obtained in the weld (4) defined by peelable parts (9) of the weld; when the container is to be opened, the parts (9) are folded outwards, in such a way as to uncover those faces (10) which were inside while the container was closed, making them accessible to contact by the mouth of a user. Arresting embossments (14) delimit the extent of peeling open of the parts (9). Releasably snap-fitting embossments (18 and 16) respectively permit maintaining open of the parts (9) and r-eclosing of the parts (9).

20 Claims, 4 Drawing Sheets

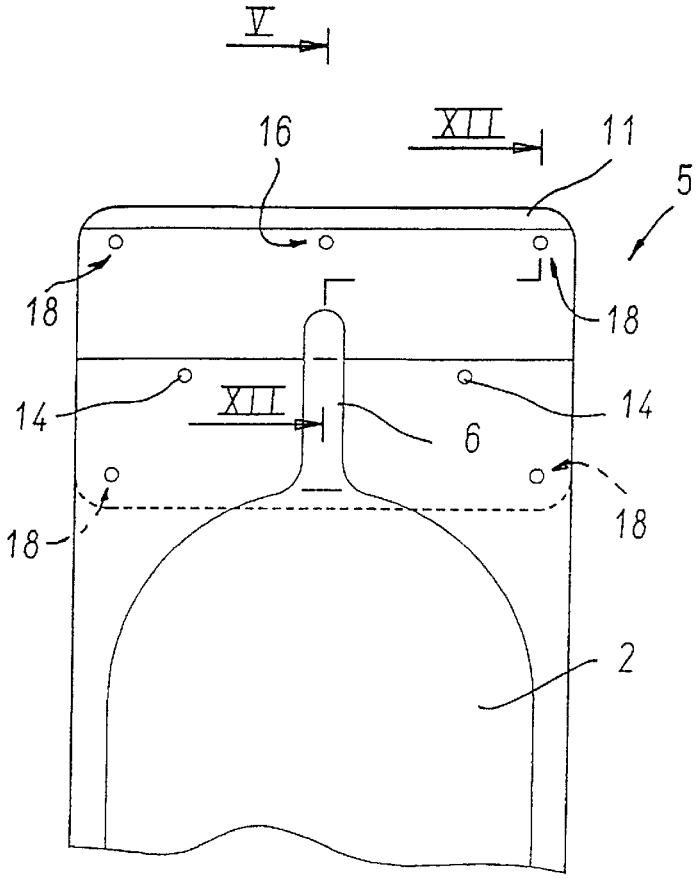
Fig. 11
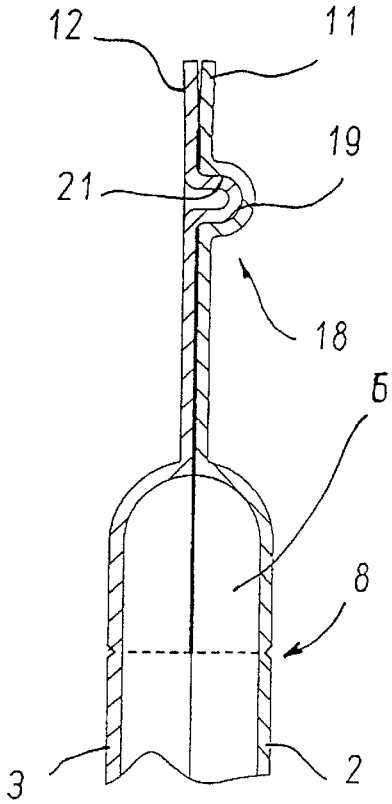
Fig. 12
Fig. 13
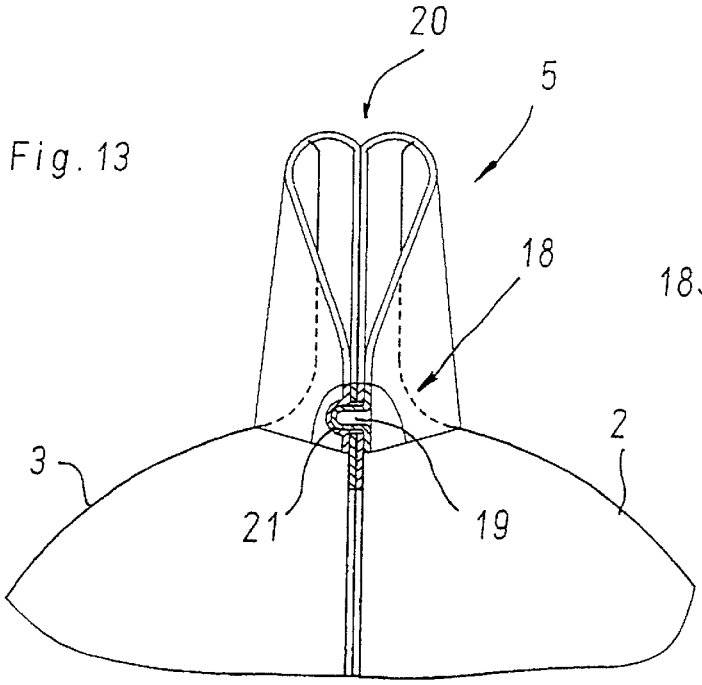
Fig. 14
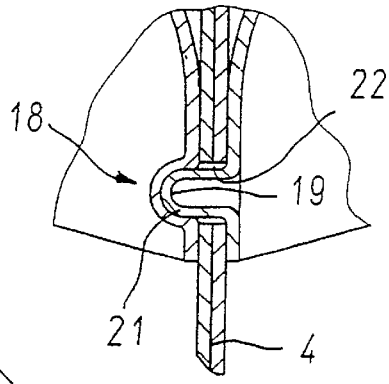

PEEL-OPENABLE CONTAINER

The invention concerns a container for a flowable product. PCT/EP97/03100 discloses a container formed by a first wall and a second wall joined together along the periphery, and at least one thereof is concave to define, together with the other wall, a cavity containing a fluid product. The container further comprises an opening zone which has an indication of separation, e.g. a line or a notch, extending from one edge to the other edge of the container for opening of the container along the indication. When such a container is used to drink the product directly, the lips of the consumer come into contact with the opening zone, which has not been hygienically protected and therefore may be dirty, or otherwise contaminated.

PCT/EP94/02493 discloses a package for edible products having a pocket-shaped part with a tubular portion the inside of which is connected to the inside of the pocket-shaped part and a handle which extends along the tubular portion, with an edible product being in the pocket-shaped part; in such a package, the pocket-shaped part and the tubular portion are formed by thermoformed shells peripherally joined along their outlines. To open the package, the weld is of a peelable type, so that a consumer may separate the shells from each other beginning by pulling away from each other non-welded lugs which are of the respective shells and protrude from the peripheral weld.

The handle may be provided with an internal conduit and therefore act as a straw for drinking a liquid product which is inside the pocket-shaped part. In this case, the package is not opened completely, but just as much as necessary to uncover a sufficient part of the straw for use.

Such containers maintain optimal hygienic conditions because the straw is protected by the tubular portion of the package until opening.

EP-A-0816252 discloses a container in the form of a sachet for packaging of biological liquid substances and having a peelable opening for the introduction of cannulae, tubes and probes. The sachet is constituted by two thermoplastics sheets welded together along a weld bounding a pocket to the top of which extends a filling conduit. One of the two sheets has in its top part a wax zone of peelability. After filling, the sachet is sealed at a transverse seeling zone inside the zone of peelability, in the region of the upper part of the conduit. The sachet can be opened easily, without recourse to a cutting tool, at the desired zone, by manually separating the two sheets and, for example, a probe can be introduced through the conduit into the pocket.

A main aim of the invention is to improve the known containers.

According to one aspect of the present invention, there is provided a container for a flowable product, comprising a first wall and a second wall of which at least one is concave, which define therebetween a cavity wherein the product is contained, and which are joined together round substantially the whole of the periphery of the cavity by means of a peelable weld, and an opening zone of said weld including parts of the walls, characterized in that said opening zone is delimited by localized portions of the first and second walls in the region of said peelable weld which are of lower peelability than said peelable weld.

Owing to this aspect of the invention, it is possible to simplify the manufacture of the containers whilst nevertheless reducing the risk of the two walls being pulled apart too far on opening of the container. The simplification of manufacture can be obtained because both walls can be made totally of peelable material, whilst the peel-arresting means provided by the localized portions can be made by mechanical deformation and/or thermowelding carried out when two sheets from which the respective walls are formed are being peelably welded together or blow thermoformed, for example.

The localized portions of the two walls may be so much lower in peelability as not to be peelable at all.

According to another aspect of the present invention, there is provided a container for a flowable product, comprising a first wall and a second wall of which at least one is concave, which define therebetween a cavity wherein the product is contained and which are joined together around the periphery of the cavity by means of a weld, an opening zone of said weld including parts of the walls, characterized in that maintaining means serves to maintain said parts in the open condition.

Owing to this aspect of the invention, it is possible for a consumer to prevent the opened parts from returning towards their closed condition until the consumer so desires. If desired, those parts of the two walls other than the parts at the opening zone may be non-peelably welded together; however, it is preferred that they be peelably welded together, particularly in order to simplify manufacture of the container.

In particular, it is possible to improve the hygienic conditions of the opening zone of a container, especially in a container wherein there is not provided a straw for drinking the product directly.

When the container is to be opened, the wall parts of the opening zone can be pulled away from each other, so that the cavity of the container communicates with the outside environment. The parts of wall may be folded outwards, so that those faces which were inside when the container was closed and were in hygienically protected conditions, now face outwards possibly to come into contact with the lips of a consumer and particularly to obstruct the lips from coming into contact with the exterior surface of the container. Therefore, the hygienic conditions relating to consuming the product directly from the container are greatly improved. Moreover, once opened, the parts folded outwards create an opening with rounded edges, so preventing the container from damaging the mouth of the consumer.

In order that the invention may be clearly and completely disclosed, reference will now be made, by way of example, to the accompanying drawings, wherein:

FIGS. 11, 12, 13 and 14 are views and sections respectively corresponding to those of FIGS. 7, 8, 9 and 10, but relative to a variant of the means for maintaining the open condition of the container.

Figure 1:
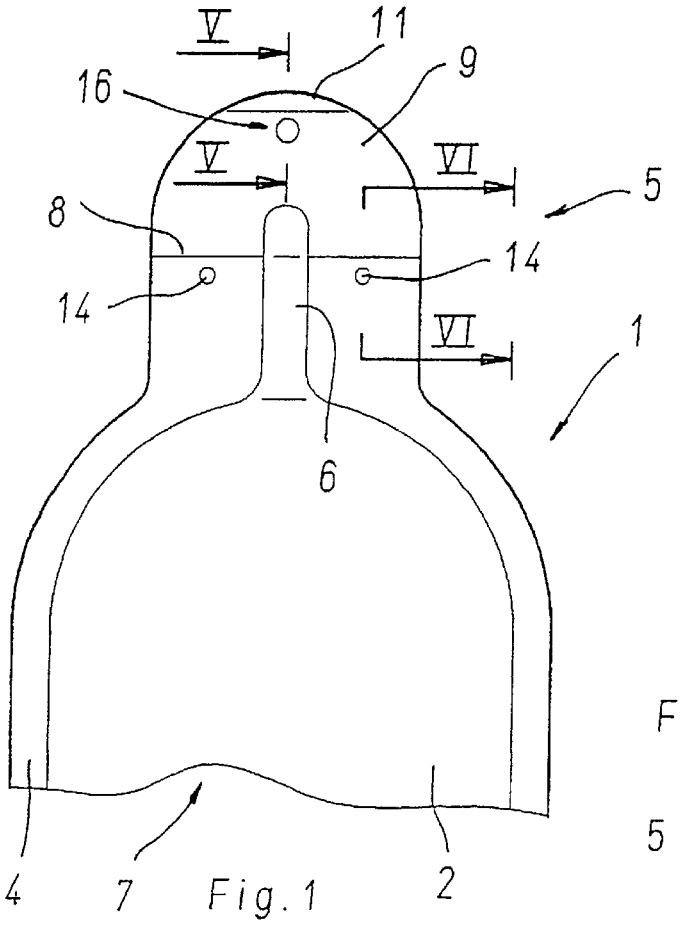
FIG. 1 is a fragmentary front view of a container.
Figure 2:
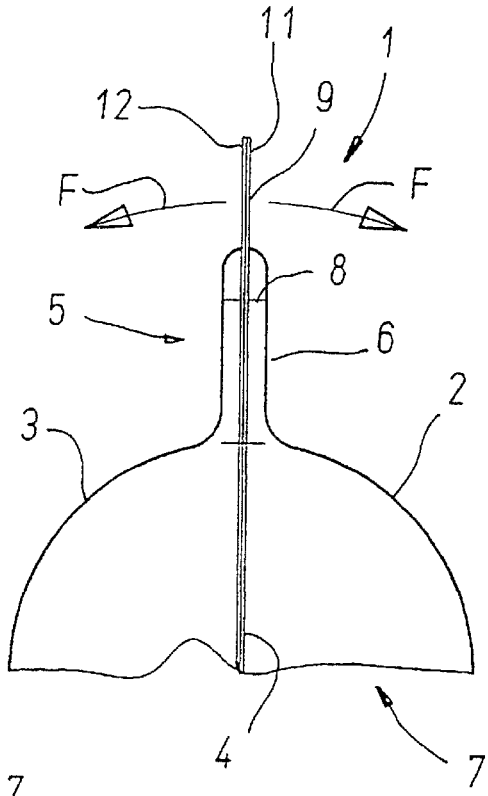
FIGS. 2 and 3 are respectively a fragmentary side view and a top view of the container.
Figure 3:
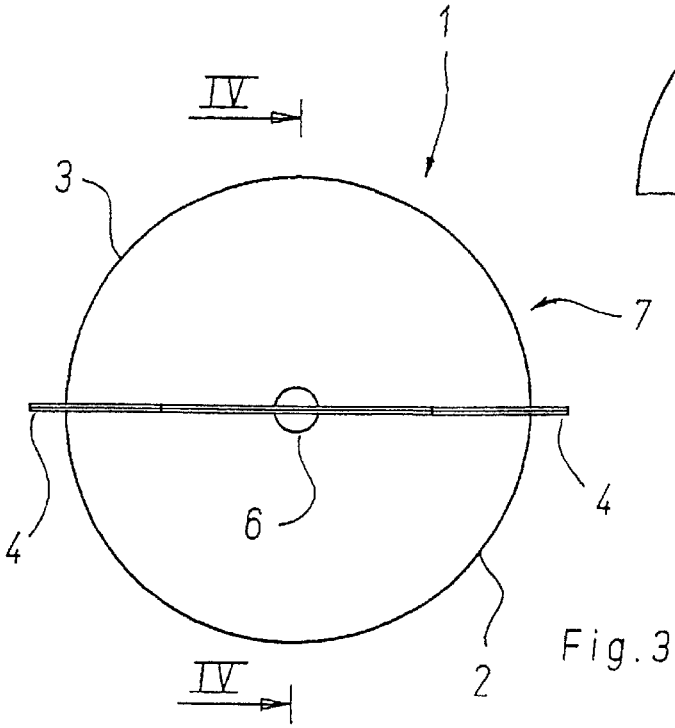
Figure 4:
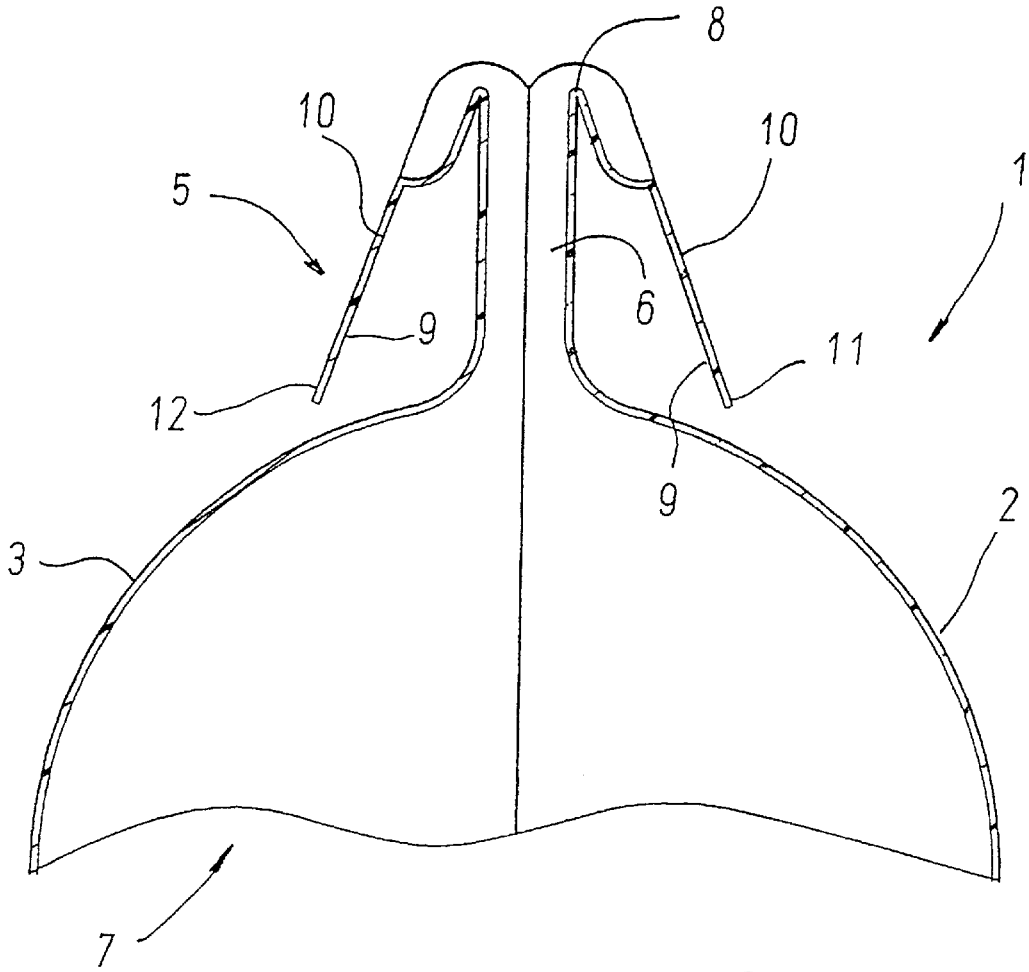
FIG. 4 is a section taken along the plane IV—IV of FIG. 3, but with the container in an open condition.

As shown in FIGS. 1 to 3, a container 1 is formed by a first wall 2 and a second wall 3, being semishell-shaped to define a cavity 7 wherein a liquid, or pasty, product is contained. The product has been filled into the container by way of the bottom (not shown) of the container. The walls 2 and 3 are joined along the periphery of the cavity 7 and the container 1 by a peelable thermoweld 4. The container 1 has an opening zone 5 up to which extends a conduit 6, which is connected to the cavity 7. The zone 5 is crossed externally by an indication 8 of preferred folding which extends over the exterior surface of the conduit 6 to the external edges of the thermoweld 4 which bounds the conduit 6 on three sides thereof.

At the opening zone 5, the peelable thermoweld 4 has parts 9 which bound that end part of the conduit 6 farther from the cavity 7. The areas of the parts 9 are such that, when the container is open, their faces 10 are large enough to obstruct the mouth of the container from coming into contact with the external surface of the container 1.

Moreover, in the closed condition of the container the faces 10 are in peelable sealed contact with each other and are thus out of contact with the outside environment and thereby protected against contamination.

The walls 2 and 3 are further provided with flaps 11 and 12, respectively, which are not welded and are wide enough for being seized by a user to open the container 1 by moving the walls 2 and 3, at the peelable weld parts 9, away from each other, in the senses shown by the arrows F in FIG. 2.

Figure 6:
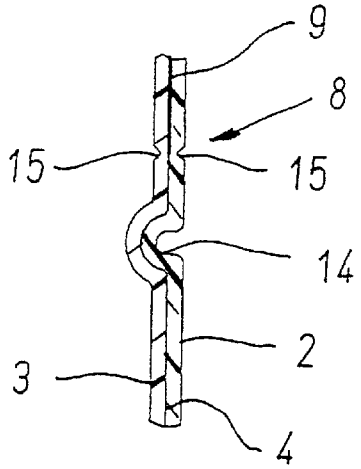

As shown more clearly in FIG. 6, at the boundary of the opening zone 5 adjacent the indication 8 of preferred folding, there are provided in the walls 2 and 3 deformations in the form of embossments 14, acting as arresting means to prevent the walls 2 and 3 from being unintentionally separated beyond the indication 8. The indication 8 may be obtained by making an incision 15 in the form of a groove in one, or both, of the walls 2 and 3.

Figure 5:
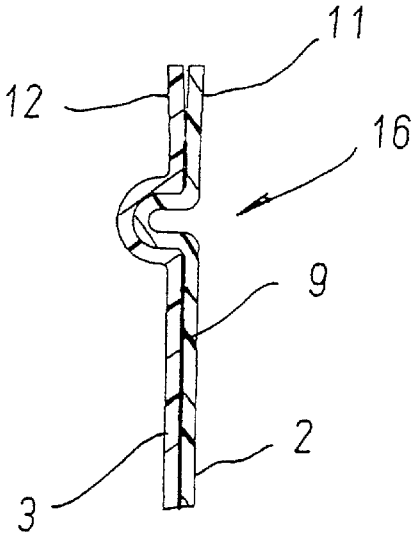
FIGS. 5 and 6 are enlarged and fragmentary sections taken along the planes V—V and VI—VI of FIG. 1.

As shown in FIG. 5, the opening zone 5 of the thermoweld 4 may be provided with releasable re-closing means 16, for example formed by corresponding and mutually coupled embossments of the walls 2 and 3, such as to define a snap closure to re-close the container after the first opening and protect the faces 10 for further use, so as to prevent contamination from the external environment even though the container has been opened.

Figure 7:
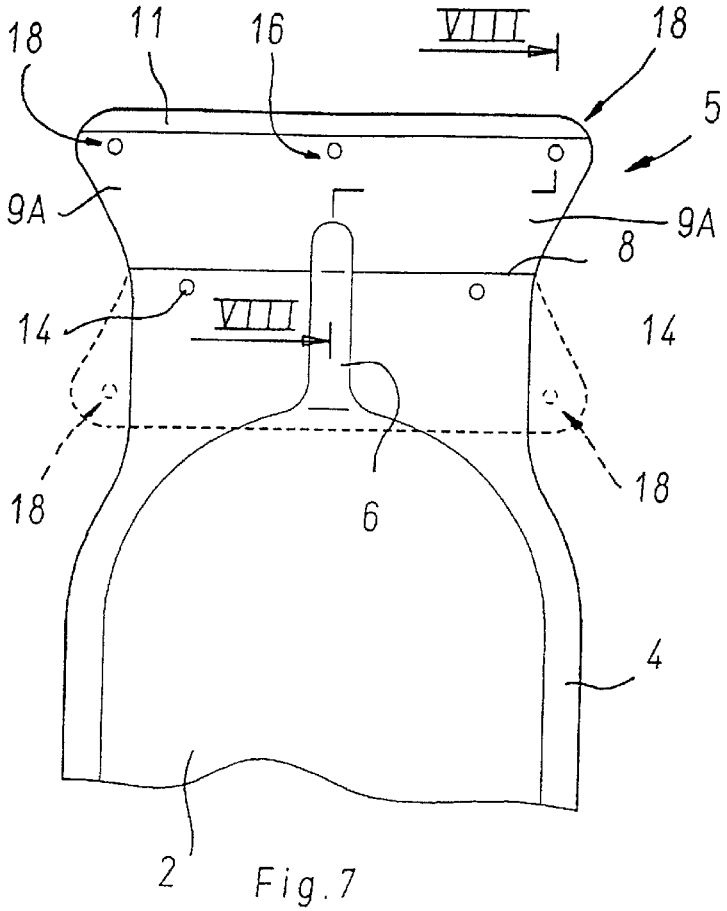
FIG. 7 is a view as in FIG. 1, but relative to a container provided with means for maintaining the open condition.
Figure 8:
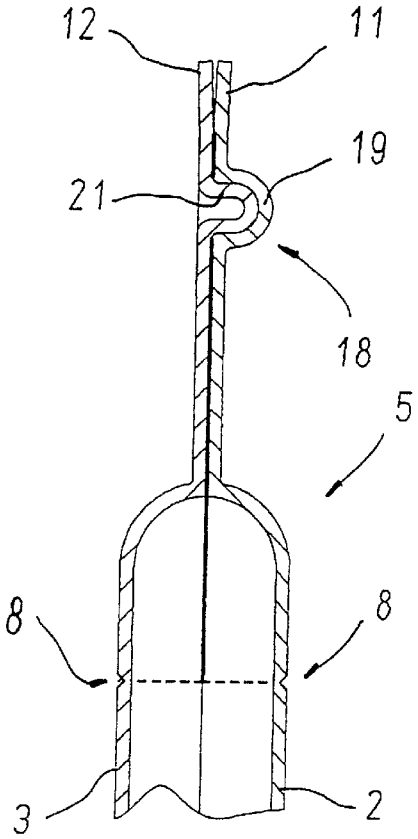
FIG. 8 is an enlarged section taken along the offset planes VIII—VIII of FIG. 7.
Figure 9:
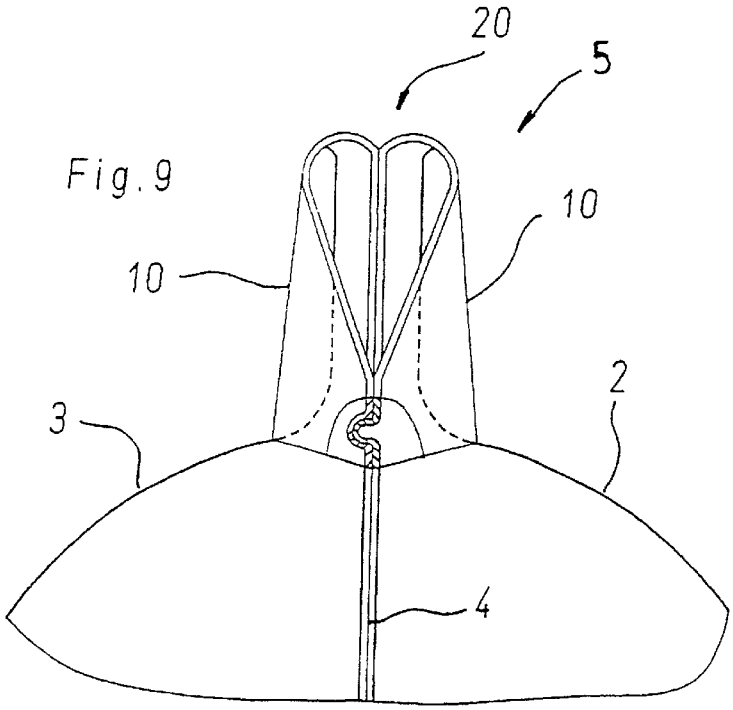
FIG. 9 is a side view of the container of FIG. 7, partly sectioned, with the container in the open condition.
Figure 10:
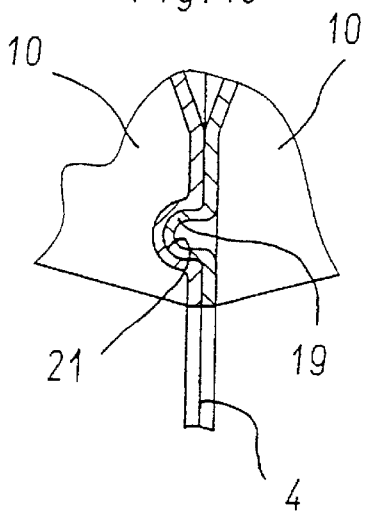
FIG. 10 is an enlarged section of the zone of coupling of the means for maintaining the open condition of the container, with the container in the open condition.

As shown in FIG. 7, the parts 9 may comprise releasable means 18 suitable for maintaining the open condition of the container 1, for example formed by embossments of the material forming the thermoweld 4, similar to those constituting the re-closing means 16.

When the container has been opened, i.e. the conduit 6 communicates with the external environment through the opening 20, the flaps 11 and 12 can continue to be pulled away from each other, to bring them to the positions shown in broken lines in FIG. 7, wherein the external surfaces of the parts 9 are against each other and the faces 10 face towards the external environment. The means 18 for maintaining the open condition have an appendix 19 of one of the walls 2 and 3 which snap-fits a complementary cavity 21 in the opposite wall.

In order to permit the appendices 19 and cavities 21 to couple together, they are located on lobes 9A laterally protruding from the parts 9 beyond the ends of the preferred folding line 8.

As shown in FIGS. 11 to 14, each appendix 19 and the complementary cavity 21 snap-fit together with insertion from opposite sides of the thermoweld 4, which, therefore, is provided with an aperture 22 (FIG. 14) wide enough to allow the passage through it of the corresponding appendix 19.

I claim:

1. Container for a flowable product, comprising a first wall and a second wall of which at least one is concave, which define therebetween a cavity wherein The product is contained, and which are joined together along substantially the whole length of the periphery of the cavity by means of a peelable weld, and an opening zone of said peelable weld including parts of said first and second walls, said opening zone being delimited by localized portions of the first and second walls in the region of said peelable weld which are of lower peelability than said peelable weld, wherein said parts are of areas large enough that when in their open condition they obstruct contact between the mouth of a user and an exterior surface of the container.

2. Container according to claim 1, wherein said opening zone (5) extends around an outer end part of an outlet conduit (6) forming an extension of said cavity (7).

3. Container according to claim 2, wherein said localized portions (14) are at respective opposite sides of said outlet conduit (6).

4. Container according to any preceding claim, wherein said localized portions comprise deformations in said first and second walls.

5. Container according to claim 4, wherein said localized portions (14) comprise embossments (14).

6. Container according to claim 1, and further comprising preferred folding indicator means acting to indicate preferred outward turning lines of said parts during opening of the container.

7. Container according to claim 6, wherein said preferred folding indicator means comprise a groove in at least one of said first and second walls and extending from one edge to an opposite edge of the container.

8. Container according to claim 1, and fiber comprising re-closing means for rejoining said parts after opening.

9. Container according to claim 1, and further comprising maintaining means for maintaining said pans in their open condition.

10. Container according to claim 8, or 9, wherein at least one of said re-closing means and said maintaining means is located in said parts.

11. Container according to claim 10, wherein at least one of said re-closing means and said maintaining means comprise at least one appendix and at least one corresponding cavity which are mutually couplable.

12. Container according to claim 9, wherein said maintaining means, when operative, extends through at least one aperture through said first and second walls.

13. Container according to claim 12, wherein said maintaining means is located on outwardly protruding lobes of said parts.

14. Container for a flowable product, comprising a first wall and a second wall of which at least one is concave, which define therebetween a cavity wherein the product is contained and which are joined together along the periphery of the cavity by means of a weld, an opening zone of said weld including parts of the first and second walls, the container including maintaining means serving to maintain said parts in an open condition.

15. Container according to claim 1, and further comprising re-closing means (16) for re-joining said parts (9) after opening.

16. Container according to claim 14, or 15, wherein at least one of said re-closing means (16) and said maintaining means is located in said parts.

17. Container according to claim 16, wherein at least one of said re-closing means and said maintaining means comprise at least one appendix and at least one corresponding cavity which are mutually couplable.

18. Container according to claim 14, wherein said maintaining means, when operative, extends through at least one aperture through said walls.

19. Container according to claim 17, wherein said maintaining means is located on outwardly protruding lobes of said parts.

20. Container according to claim 14, wherein said parts are of areas large enough that when in their open condition they obstruct contact between the mouth of a user and an exterior surface of the container.

* * * * *

UNITED STATES PATENT AND TRADEMARK OFFICE

CERTIFICATE OF CORRECTION

PATENT NO. : 6,435,374 B1
DATED : August 20, 2002
INVENTOR(S) : Roberto Tabaroni It is certified that error appears in the above-identified patent and that said Letters Patent is hereby corrected as shown below:

Title page,
Item [57], ABSTRACT,
Please delete the old ABSTRACT and replace with the following new ABSTRACT,
-- A container for a flowable product comprises a first wall and a second wall joined along their respective edges by means of a peelable weld and defining a cavity for the prodict and an opening zone obtained in the weld defined by peelable parts of the weld; when the container is to be opened, the parts are folded outward, in such a way as to uncover those faces which were inside while the container was closed, making them accessible to contact by the mouth of a user. Arresting embossments delimit the extent of peeling open of the parts. Releasably snap-fitting embossments permit maintaining open of the parts and re-closing of the parts. --

Column 1,
Line 2, insert header -- Field of the Invention --.
Line 3, insert header -- Background of the Invention --.
Line 49, insert header -- Summary of the Invention --.

Column 2,
Line 43, insert header -- Brief Description of the Drawings --.
Line 66, insert header -- Detailed Description of the Preferred Embodiments --.

Column 4,
Line 8, after “cavity wherein” delete “The” and insert therein -- the --.
Line 39, after “claim 1, and” delete “fiber” and insert therein -- further --.
Line 42, after “maintaining said” delete “pans” and insert therein -- parts --.
Line 65, after “claim” delete “1” and insert therein -- 14 --.

Signed and Sealed this

First Day of July, 2003

JAMES E. ROGAN
*Director of the United States Patent and Trademark Office*